US007141501B2

(12) United States Patent
Horikoshi et al.

(10) Patent No.: US 7,141,501 B2
(45) Date of Patent: Nov. 28, 2006

(54) POLISHING METHOD, POLISHING APPARATUS, AND METHOD OF MANUFACTURING SEMICONDUCTOR DEVICE

(75) Inventors: Hiroshi Horikoshi, Kanagawa (JP); Takeshi Nogami, Kanagawa (JP); Shuzo Sato, Kanagawa (JP); Shingo Takahashi, Kanagawa (JP); Naoki Komai, Kanagawa (JP); Kaori Tai, Kanagawa (JP); Hiizu Ohtorii, Kanagawa (JP)

(73) Assignee: Sony Corporation, Tokyo (JP)

( * ) Notice: Subject to any disclaimer, the term of this patent is extended or adjusted under 35 U.S.C. 154(b) by 41 days.

(21) Appl. No.: 10/512,745

(22) PCT Filed: Apr. 14, 2003

(86) PCT No.: PCT/JP03/04696

§ 371 (c)(1),
(2), (4) Date: Oct. 27, 2004

(87) PCT Pub. No.: WO03/092944

PCT Pub. Date: Nov. 13, 2003

(65) Prior Publication Data

US 2005/0239283 A1 Oct. 27, 2005

(30) Foreign Application Priority Data

Apr. 30, 2002 (JP) ..... 2002-128782

(51) Int. Cl.
*H01L 21/302* (2006.01)
*H01L 21/461* (2006.01)

(52) U.S. Cl. ..... 438/690; 438/691; 438/692

(58) Field of Classification Search ..... 438/690–693
See application file for complete search history.

(56) References Cited

U.S. PATENT DOCUMENTS

| | | | | |
|---|---|---|---|---|
| 5,649,855 | A * | 7/1997 | Chikaki | 451/290 |
| 5,863,307 | A * | 1/1999 | Zhou et al. | 51/307 |
| 6,080,671 | A * | 6/2000 | Crevasse et al. | 438/691 |
| 6,551,934 | B1 * | 4/2003 | Yamazaki et al. | 438/692 |
| 6,860,802 | B1 * | 3/2005 | Vishwanathan et al. | 451/527 |
| 2001/0036746 | A1 * | 11/2001 | Sato et al. | 438/745 |

FOREIGN PATENT DOCUMENTS

| | | | |
|---|---|---|---|
| JP | 2001-121405 | | 5/2001 |
| JP | 2001-170858 | | 6/2001 |
| JP | 2001-179608 | * | 7/2001 |
| JP | 2001-244223 | * | 9/2001 |
| JP | 2001-261874 | | 9/2001 |
| JP | 2001-326204 | | 11/2001 |
| JP | 2001-348271 | | 12/2001 |
| JP | 2002-059355 | | 2/2002 |

* cited by examiner

*Primary Examiner*—Carl Whitehead, Jr.
*Assistant Examiner*—Heather A. Doty
(74) *Attorney, Agent, or Firm*—Robert J. Depke; Rockey, Depke, Lyons & Kitzinger LLC

(57) ABSTRACT

A polishing method and a polishing apparatus by which excess portions of a metallic film 18 can be removed easily and efficiently in planarizing the metallic film 18 by polishing and which is high in accuracy of polishing, are provided. Also, a method of manufacturing a semiconductor device by use of the polishing method and the polishing apparatus is provided. A substrate 17 provided with the metallic film 18 and a counter electrode 15 are disposed oppositely to each other in an electrolytic solution E, an electric current is passed to the metallic film 18 through the electrolytic solution E, and the surface of the metallic film 18 is polished with a hard pad 14.

2 Claims, 10 Drawing Sheets

POLISHING METHOD, POLISHING APPARATUS, AND METHOD OF MANUFACTURING SEMICONDUCTOR DEVICE

This application claims priority to Japanese Patent Application Number JP2002-128782, filed Apr. 30, 2002 which is incorporated herein by reference.

TECHNICAL FIELD

The present invention relates to a polishing method, a polishing apparatus, and a method of manufacturing a semiconductor device.

BACKGROUND ART

Attendant on the miniaturization of semiconductor devices on a design rule basis, there has been a general tendency in the wiring process toward a shift of the wiring material from aluminum (Al) to copper (Cu) and toward the application of a lower dielectric constant material to the inter-layer insulation film. The reason for these material changes lies in that the Al wirings and the related-art inter-layer insulation film materials such as $SiO_2$ have come to be confronted by limitations, in view of wiring delay and the like problems. While the development of semiconductor devices has been progressing with the material transitions, the modifications in material are attended by great changes in the semiconductor manufacturing process.

For example, in the case of applying Cu as a wiring material, the dry etching of wirings which has been widely used for the Al wiring generations is unsuitable to Cu, which is a material susceptible to corrosion. Therefore, where Cu is processed by dry etching in the same manner as Al, the dry etching must be carried out near critical conditions on an apparatus hardware basis, i.e., under a low pressure and a high temperature, which is unadaptable to mass production process. For the Cu wiring process at present, accordingly, there is widely used a method called the Damascene process, in which a barrier film 202 is formed on an inter-layer insulation film 201 provided with trenches or holes, then the trenches or holes are filled up with Cu 203, and the Cu portions not contributing to wiring (field portions) are removed by CMP (Chemical Mechanical Polishing).

The CMP technology is a comparatively well-established technology the application of which started with the 0.5 μm design rule, at the earliest. In the beginning stage of application of the CMP technology, the material to be polished is the inter-layer insulation film. In the CMP technology, however, there are pattern dependency problems, such as different polishing rates in different wiring density areas; particularly, the phenomenon called "erosion" in which polishing is accelerated in denser wiring areas has been a great problem to be solved. These problems have been technically improved to a level satisfactory for application to mass production, through improvements in CMP hardware and improvements of CMP consumables such as slurry and pad. These improvements are owing to the material of the inter-layer insulation film, which is the member to be polished, particularly, the material represented by $SiO_2$. This is because $SiO_2$ constituting the member to be polished is a comparatively hard material, accompanied by comparatively high degrees of freedom as to CMP parameters.

However, the material to be polished by the Damascene process is Cu, which is a metallic material being soft and viscous, as compared with $SiO_2$. In addition, Cu is susceptible to reaction with an acid or alkali contained in the slurry. Due to such properties of Cu, the Cu wiring process using CMP involves the following problems.

(1) Erosion

As has been the problem in the CMP of the inter-layer insulation film (oxide film), in the areas of higher wiring density patterns, the polishing of different materials differing in polishing rate leads to the problem that a local pressure is exerted on the lower polishing rate portions as the higher polishing rate portions are polished, and the synergistic effect increases the difference in polishing rate. As a result, a scooped-out shape is formed in the area of a higher wiring density pattern, as shown in FIG. 19.

(2) Dishing

Dishing is a phenomenon in which a broad wiring portion having a width of 30 μm or more is polished in an accelerated manner, and the resulting wiring has a recessed shape as shown in FIG. 20. The dishing progresses acceleratedly according to an increase in the polishing pressure and a deformation of the polishing pad. For suppressing the dishing, it is effective to polish under a lower load. The lowering of the load, however, leads to a lowered polishing rate, rendering the polishing unadaptable to mass production process.

(3) Wiring (Cu) Recess

The wiring (Cu) recess means the condition where wiring trenches or holes formed in the inter-layer insulation film are not filled with Cu (the material for forming the wirings) up to the height of the inter-layer insulation film, as shown in FIG. 21. Therefore, the above-mentioned erosion and dishing are also kinds of recess. While the erosion and the dishing are principally and greatly dependent on the polishing pressure, chemical etching by an acid or alkali constituting the slurry is an additional cause of the recessing (etching) of Cu. Since an increase in the polishing pressure leads to the progress of erosion and/or dishing as above-mentioned, it is necessary, in application of CMP to mass production process, to investigate an enhancement of chemical reaction rate for the purpose of raising the polishing rate. This approach, however, would lead to recess formation through etching of Cu due to a chemical attack.

(4) Delamination of Inter-Layer Insulation Film

As a countermeasure against the wiring delay, not only the lowering in the resistance of the wirings but also a reduction in the capacitance of the inter-layer insulation film may be mentioned, and a specific method for reducing the capacitance resides in applying a low dielectric constant material to the inter-layer insulation film. The lowering in the dielectric constant of the inter-layer insulation film is generally contrived by forming the film from a porous material, but the use of a porous material is attended by an increase in fragility, leading to a degradation in mechanical strength. Then, the use of a porous material has the bad effect that the low dielectric constant material of the inter-layer insulation film may be delaminated under the pressure exerted in the Cu CMP, as shown in FIG. 22.

In this way, the formation of Cu wirings by the Damascene process involves the problems of reduction in film thickness of wiring portions and degradation in planarization, due to erosion, dishing, recess and the like. The reduction in film thickness of wiring portions causes a current density over the designed value to be supplied on the wirings, leading to, for example, a lowered electromigration (EM) resistance and, hence, to a great damage to the reliability of the wiring.

On the other hand, a shape including a non-planarity such as erosion induces pattern formation defects. Then, in the lithography step, an increase in absolute steps lowers the DOF (Depth of Focus) and, therefore, it is impossible to form the desired pattern. This tendency becomes conspicuous particularly in more miniaturized patterns. Besides, the absolute steps are more emphasized attendant on an increase in the number of wiring layers. For example, in the case of a layout in which the step portions are stacked, the recessing is augmented by the step amount, whereby the absolute steps are enlarged. The increase of the step corresponds to a trench portion in the inter-layer insulation film, so that Cu will remain in the stepped portion upon the Cu CMP, resulting in a fatal defect of shortcircuit in the semiconductor device, as shown in FIG. 23.

In addition, the application of the low dielectric constant material to the inter-layer insulation film involves the problem that, since the low dielectric constant material is a fragile material, as above-mentioned, the low dielectric constant material is delaminated under the pressure or load exerted in the CMP, resulting in a fatal damage.

Meanwhile, a Cu polishing method in which electropolishing is conducted under a low-pressure or pressure-free condition has recently been developed as a polishing and planarizing method compatible with the use of a low dielectric constant material. This technology is characterized in that the surface of Cu constituting the film to be polished is converted, by application of an electrolytic voltage, into a reaction layer easy to polish or a reaction layer capable of being dissolved without polishing, and Cu is planarized. However, such a low-pressure electropolishing technology still remains, in many cases, in a hardware form situated on the extension of CMP, and low-pressure polishing on such a satisfactory level as to solve the above-mentioned problems has not yet been realized.

Thus, a technique which enables to solve the problems of shape defects such as erosion, dishing, recess, etc. and delamination of the fragile low dielectric constant material and to form Damascene wirings in favorable shape and with high reliability has not yet been established.

The present invention has been made in consideration of the above-mentioned status quo. Accordingly, it is an object of the present invention to provide a polishing method and a polishing apparatus by which excess portions of a metallic film can be removed easily and efficiently in planarizing the metallic film by polishing and which promise high-accuracy polishing. It is another object of the present invention to provide a method of manufacturing a semiconductor device by use of the polishing method and the polishing apparatus.

DISCLOSURE OF INVENTION

In order to attain the above object, according to the present invention, there is provided a polishing method including the steps of: disposing a substrate provided thereon with a metallic film and a counter electrode oppositely to each other in an electrolytic solution, passing an electric current to the metallic film through the electrolytic solution, and polishing the surface of the metallic film with a hard pad, to thereby polish the metallic film.

In the polishing method according to the present invention as above, the metallic film is polished with the hard pad under a pressure much lower than that in CMP, whereby it is possible to prevent over-polishing of the metallic film and to prevent shape defects such as erosion, dishing, recess, etc. from being generated. In addition, since the pressure exerted on the substrate can be reduced, there is no possibility of such inconveniences as delamination of a fragile material. Therefore, polishing with a higher accuracy can be realized.

Beside, in order to attain the above object, according to the present invention, there is provided a polishing apparatus for polishing a metallic film formed on a substrate in an electrolytic solution, the apparatus including: a counter electrode disposed oppositely to the substrate; a power source for supplying a voltage, with the substrate as anode and with the counter electrode as cathode; and a hard pad slidingly moved on the substrate so as to polish the metallic film.

In the polishing apparatus according to the present invention configured as above, the metallic film is polished by using the hard pad as a polishing pad and under a pressure much lower than that in CMP, whereby it is possible to prevent over-polishing of the metallic film and to prevent shape defects such as erosion, dishing, and recess from being generated. In addition, since the pressure exerted on the substrate can be reduced, there is no possibility of such inconveniences as delamination of a fragile material. Therefore, polishing with a higher accuracy can be realized.

Furthermore, in order to attain the above object, according to the present invention, there is provided a method of manufacturing a semiconductor device, including the steps of providing an insulation film formed on a substrate with wiring trenches for forming metallic wirings, forming a metallic film on the insulation film so as to fill up the wiring trenches, and polishing the metallic film formed on the insulation film, wherein, in the step of polishing the metallic film, the substrate provided with the metallic film and a counter electrode are disposed oppositely to each other in an electrolytic solution, an electric current is passed to the metallic film through the electrolytic solution, and the surface of the metallic film is polished with a hard pad, to thereby polish the metallic film.

In the method of manufacturing a semiconductor device according to the present invention as above, in forming the metallic wirings, the metallic film formed on the insulation film is polished by using the hard pad and under a pressure much lower than that in the related-art CMP, whereby over-polishing of the metallic film can be prevented from occurring. This makes it possible to prevent shape defects such as erosion, dishing, and recess from being generated. In addition, since the pressure exerted on the substrate can be reduced, there is no possibility of such inconveniences as delamination of a fragile material. Therefore, polishing with a higher reliability can be realized, and metallic wirings in favorable shape can be formed.

BEST MODE FOR CARRYING OUT THE INVENTION

Figure 1:
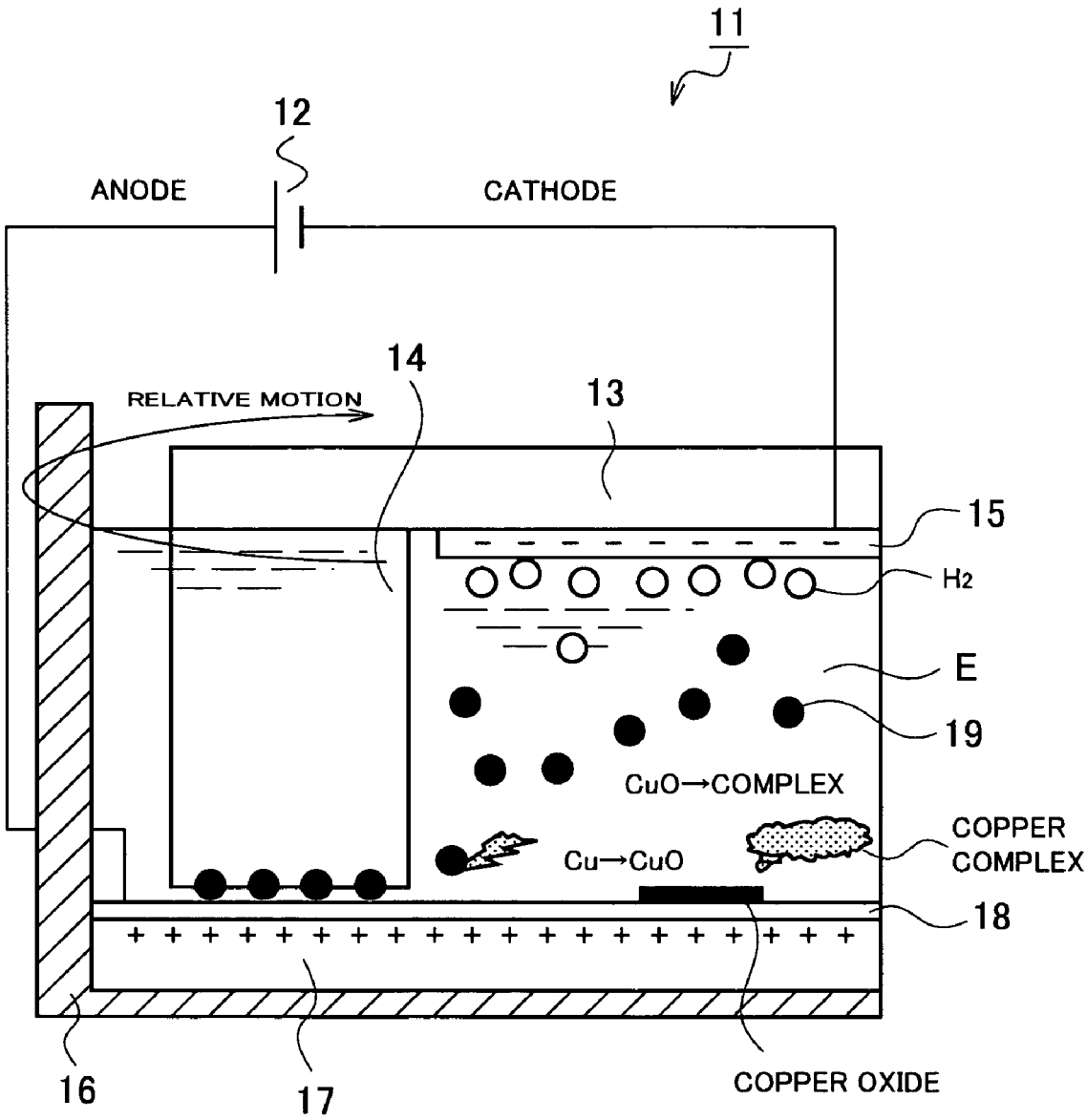
FIG. 1 shows the general configuration of the polishing apparatus according to the present invention.

Now, the polishing method, the polishing apparatus, and the method of manufacturing a semiconductor device according to the present invention will be described in detail below, referring to the drawings. In the following drawings, the contraction scale may differ from the true scale, for ease of understanding. Besides, the present invention is not limited to or by the following description, and modifications can be appropriately made without departure from the scope of the gist of the invention.

The polishing method according to the present invention is characterized in that a substrate provided thereon with a metallic film and a counter electrode are disposed oppositely to each other in an electrolytic solution, an electric current is passed to the metallic film through the electrolytic solution, and the surface of the metallic film is polished with a hard pad, to thereby polish the metallic film.

In addition, the polishing apparatus according to the present invention is a polishing apparatus for polishing in an electrolytic solution a metallic film formed on a substrate, characterized by including: a counter electrode disposed oppositely to the substrate; a power source for supplying a voltage, with the substrate as anode and with the counter electrode as cathode; and a hard pad slidingly moved on the substrate so as to polish the metallic film.

Further, the method of manufacturing a semiconductor device according to the present invention is one including the steps of: providing an insulation film formed on a substrate with wiring trenches for forming metallic wirings, forming a metallic film on the insulation film so as to fill up the wiring trenches, and polishing the metallic film formed on the insulation film, characterized in that, in the step of polishing the metallic film, the substrate provided with the metallic film and a counter electrode are disposed oppositely to each other in an electrolytic solution, an electric current is passed to the metallic film through the electrolytic solution, and the surface of the metallic film is polished with a hard pad, to thereby polish the metallic film.

The following description will be made by taking as an example the case of planarization of Cu wirings in a semiconductor wiring process, namely, the case where the metallic film formed on a substrate is a Cu film. First, the problems experienced in the case of polishing and planarizing a Cu film on a substrate by the Cu CMP, which is a related-art technology, will be described. Where a Cu film formed on a substrate is polished and planarized by the Cu CMP, the following inconveniences are generated. Namely, where the Cu film is polished and planarized by the Cu CMP, process defects such as erosion, dishing, wiring recess, and delamination of an inter-layer insulation film are generated, leading to marked defects in the semiconductor devices manufactured.

Taking the case of erosion as an example, the influence of such a process defect will be described. For example, when erosion is generated in the case of forming Cu wirings on a semiconductor substrate, the film thicknesses of the inter-layer insulation film and the Cu wirings are reduced by the erosion, whereby the sectional area of the wiring is reduced. For example, in the case of wirings with a width of 0.12 μm and a height of 0.12 μm, when the film thickness is reduced by 0.05 μm due to erosion, the current density applied to the eroded portion of the wiring will be 1.7 times the designed current density. Calculation of the wiring life by use of Black's equation shows that, let the current density index be n=2, the increase in current density by a factor of 1.7 results in that the wiring life of the eroded wiring is about ⅓ times the designed wiring life. In addition, the lowered dielectric constant in relation to the wiring capacitance causes reductions (in thickness and size) of the inter-wiring inter-layer insulation film (wiring height) and wiring width, whereby electromigration (EM) is accelerated further. Besides, there is little design margin as to the wiring life; therefore, a decrease in the wiring life may constitute a fatal defect in regard of reliability of the wiring.

In addition, attendant on an increase in the number of wiring layers, the wiring formation defects such as erosion may cause an inter-wiring shortcircuit (wiring shortcircuit) upon integration, or may cause exfoliation (delamination) of the inter-layer insulation film in the Cu CMP Damascene process. In the case of manufacturing a semiconductor device, for example, these defects greatly influence the functional yield of the semiconductor chips, making it impossible to secure non-defective chips. This considerably degrades the productivity of the semiconductor chips, leading to a huge loss or damage. That is to say, in the case of manufacturing a semiconductor device miniaturized by applying Cu wirings and a low dielectric constant film, an adoption of the Cu CMP Damascene process causes generation of the above-mentioned defects in the manufacturing process and, in regard of the reliability of wiring, is attended by degradation of EM resistance due to the reduction in the wiring film thickness.

In order to solve the above-mentioned problems, the present invention provides the following polishing method and polishing apparatus in which an electropolishing technique is used as a Cu polishing technique in place of the Cu CMP. First, the polishing apparatus according to the present invention will be described. FIG. 1 shows the general configuration of the polishing apparatus 11 according to the present invention. In the polishing apparatus 11, as shown in FIG. 1, a substrate 17 provided on its surface with a Cu film 18 is disposed, in the state of being held by a substrate holding member (not shown), in an electrolytic tank 16 charged with an electrolytic solution E. In the electrolytic tank 16, in addition, a surface plate 13 formed in a roughly circular disk-like shape and serving as a holding member for a polishing pad 14 and a counter electrode (cathode) 15 is disposed oppositely to the substrate 17, with a predetermined distance therebetween. Here, the polishing pad 14 is fixedly held on the surface plate 13 on the side of the substrate 17. Besides, a moving means (not shown) is provided whereby the surface plate 13 can be moved in the vertical direction, i.e., toward or away from the substrate 17 while remaining parallel to the substrate 17. Also, a rotating means (not shown) is provided whereby the surface plate 13 can be turned about the center axis of the surface plate 13. In addition, the counter electrode (cathode) 15 is fixedly disposed at a radially inside position of the surface plate 13. Further, the substrate 17 and the counter electrode 15 are both connected with an electrolytic voltage supplying power source 12.

The polishing method for polishing the Cu film 18 formed on the substrate 17 by use of the polishing apparatus 11 as above will be described below.

First, the substrate 17 as the member to be polished is disposed in the electrolytic tank 16 filled with the electrolytic solution E. Then, with the substrate 17 as anode, an electrolytic voltage is supplied between the substrate 17 and the counter electrode 15 through the electrolytic solution E to pass electric current through electrolyte, thereby passing the current to the Cu film 18. As a result, the surface of the Cu film 18 undergoing an electrolytic action as anode is anodically oxidized, and a copper oxide coating (CuO) is formed at a surface layer of the Cu film 18. Then, the copper oxide and a copper complex forming agent contained in the electrolytic solution E react with each other, i.e., form a copper complex, whereby a reaction layer such as a high electric resistance layer, an insoluble complex coating, and a passivation coating, formed from the complex forming agent substance, is formed on the surface of the Cu film 18. In this manner, the copper complexing rate can be enhanced by supplying the voltage between the substrate 17 and the counter electrode 15 by the electrolytic voltage supplying power source 12.

In addition, in the polishing method according to the present invention, wiping of the surface of the Cu film 18 with the polishing pad 14 is conducted simultaneously with the above-mentioned electropolishing. The wiping is conducted by pressing the polishing pad 14 against the anodically oxidized surface of the Cu film 18 under a predetermined pressure and sliding the polishing pad 14 on the Cu film 18, whereby the reaction layer coating present at the surface layer of projected portions of the Cu film 18 having an unevenness is removed, to expose the underlying Cu, and the exposed Cu portions are re-electrolyzed.

Though dependent on the kind of the copper complex, the adhesion between the copper complex and the uncomplexed portion of copper (hereinafter referred to as the uncomplexed copper) is very weak, so that, due to the convection of the electrolytic solution E in the electrolytic tank 16, the copper complex would be released from the uncomplexed copper, namely, from the uncomplexed copper on the substrate 17, and would float into the electrolytic solution E. With the convection of the electrolytic solution E only, however, the speed of release of the copper complex from the uncomplexed copper is low. Therefore, in order to enhance the release speed contributing to the removal of the copper complex, the polishing pad 14 attached to the surface plate 13 is pressed against and slid on the substrate 17, to wipe the surface of the Cu film 18. Specifically, the surface plate 13 is pressed against the surface of the Cu film 18 under a predetermined pressure, and is turned in a plane parallel to the substrate 17 with the center axis of the surface plate 13 as a center. This makes it possible to enhance the speed of release of the copper complex from the substrate 17, and to release the copper complex from the substrate 17 and planarize the surface of the substrate 17, efficiently. Incidentally, the wiping in the present invention includes a rubbing function, a grinding-off function, and a wiping-off function.

The cycle of the electropolishing and the wiping is repeatedly conducted, whereby the Cu film 18 formed on the substrate 17 is polished, and the planarization proceeds.

With the polishing of the Cu film 18 carried out by the above-described polishing method, it is possible to pass the electric current stably and with a uniform current density distribution, and to polish under favorable polishing rate and polishing conditions.

Incidentally, in the above-described polishing method, an electrolytic liquid containing abrasive grains 19 as shown in FIG. 1 may be used, for enhancing the planarizing ability. By the wiping with the abrasive grains mixed in the electrolytic liquid, it is possible to release the copper complex from the substrate 17 and polarize the surface of the substrate 17, more efficiently.

In addition, while the wiping is conducted in the condition where the polishing pad 14 itself is driven for rotation or the like, the substrate 11 may also be rotated in the direction reverse to the driving direction of the polishing pad 14 at the time of wiping.

Besides, in the present invention, a hard pad is used as the polishing pad 14 in conducting the electropolishing as above. Specifically, in the present invention, a hard polishing pad is used from the viewpoint of low-pressure polishing, whereby polishing and planarization with higher accuracy can be realized.

In the related-art Cu CMP technology, a high pressure is exerted; for this reason, a soft polishing pad is used for securing a follow-up performance relative to the member to be polished, so as thereby to enhance the in-plane uniformity of the member polished. Accordingly, planarity is sacrificed to some extent, in practice of the related-art Cu CMP technology.

On the other hand, in the case of the so-called low-pressure electropolishing in which the metallic film formed on the substrate is planarized by the electropolishing and the simultaneous wiping with pad based on the above-mentioned polishing principle, the copper complex with weak adhesion to the uncomplexed copper is formed in the presence of the electrolytic solution and the electrolytic voltage supplied. In the case of the low-pressure electropolishing, therefore, the polishing can be performed under a pressure lower than the polishing pressure exerted in the Cu CMP, namely, the pressure of 4 to 7 PSI (1 PSI is equivalent to about 70 g/cm$^2$). Besides, it is possible to polish under a polishing pressure of not more than 1.5 PSI, which value is said to be the limit relating to the delamination of porous low dielectric constant materials; as for the polishing rate, further, it is possible to sufficiently achieve a polishing rate considered to be adaptable to mass production (>500 nm/min). In addition, even with a polishing pressure of not more than 1.0 PSI, it is possible to achieve a polishing rate adaptable to mass production (>5000 A/min).

However, the ordinary low-pressure electropolishing follows the CMP technique and uses a comparatively soft pad formed of foamed polyurethane, suede, or the like in consideration of follow-up performance relative to the member to be polished, so that it is difficult to realize a planarity with a higher accuracy by the ordinary low-pressure electropolishing.

Paying attention to the polishing pad in the low-pressure electropolishing, it is possible in the low-pressure electropolishing to achieve polishing under an extremely low pressure as above-mentioned, so that it is unnecessary to take into account the follow-up performance of the polishing pad relative to the member to be polished, for securing the in-plane uniformity, which is a problem in the CMP technology. In other words, in the low-pressure electropolishing, it is possible to design the system while ignoring the uniformity upon polishing.

In view of the above, in the present invention, a hard pad is used as the polishing pad, for realizing polishing and planarization with a higher accuracy. By use of the hard polishing pad, it is possible to effectively restrain the problems which might be encountered in the Cu CMP, such as erosion, dishing, recess, and delamination of the low dielectric constant material, and to realize a planarity with a higher accuracy.

Specific examples of the physical properties and form of the hard pad which can be used in the present invention are given as follows.

<Physical Properties of Pad> (At Normal Temperature)
Hardness: Shore D hardness 60 or above
Density: 0.80 g/cm$^3$ or above
Compressibility: 1.0% or below
Elastic recovery: 70% or below
Compressive strength: 7 kPa or below (per 1 mm thickness under 0.01% compression)
Young's modulus: 10 kPa or above <Surface Condition of Pad>
Surface roughness: Comparable to the size of abrasive grains, 0.2 μm or below on standard
Surface shape: Processing of trenches or the like is arbitrary, provided that in the case of forming trenches, the trench processing area is not more than 30% of the chip size. The trench processing width is preferably not more than 5 nm, and the trench height is preferably not more than 80% of pad height, or not more than 10 mm.

<Pad Form>
Size: not less than 4 times the chip area

<Typical Pad Materials>
Thermoplastic resins (polyethylene, polystyrene, fluororesins, polyvinyl chloride, polyesters, polypropylene, methacrylic resin, polycarbonate, polyimides, polyacetal, etc.), PTFE (polytetrafluoro-ethylene), PBI (polybenzoindasole), PEI (polyamide-imide), PPS (polyphenylene sulfide), PEEK (polyether-ether ketone), GYLON, ultrahigh-polymeric polyethylene, phthalocyanine, graphite fluoride, molybdenum diselenide, tungsten disulfide, and molybdenum disulfide can be used. Also usable are metallic materials lower in ionization tendency than Cu, for example, silver, palladium, iridium, platinum, gold, etc.

Figure 2:
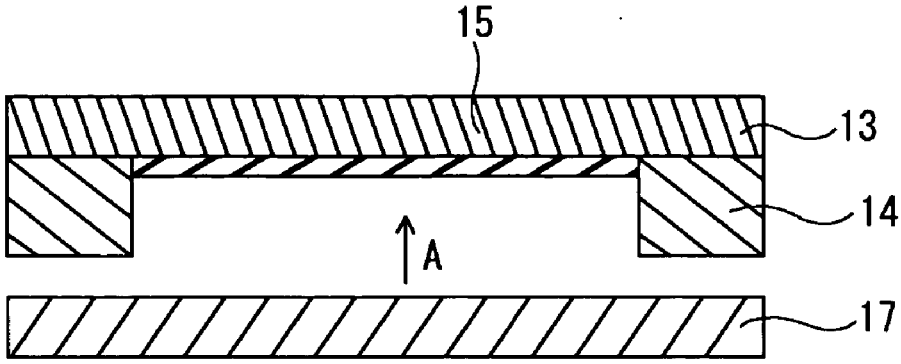
FIG. 2 is a sectional view showing a basic configuration example of a hard pad.

<Configuration Examples of Polishing Pad and Counter Electrode>
The polishing pad 14 and the counter electrode 15 may be configured, for example, according to the following Configuration Examples 1 to 7. Incidentally, FIG. 2 is a sectional view showing the basic sectional structure of each of the configuration examples. In the following examples, description will be made referring to the plan view as viewed along arrow A in FIG. 2.

Configuration Example 1

Figure 3:
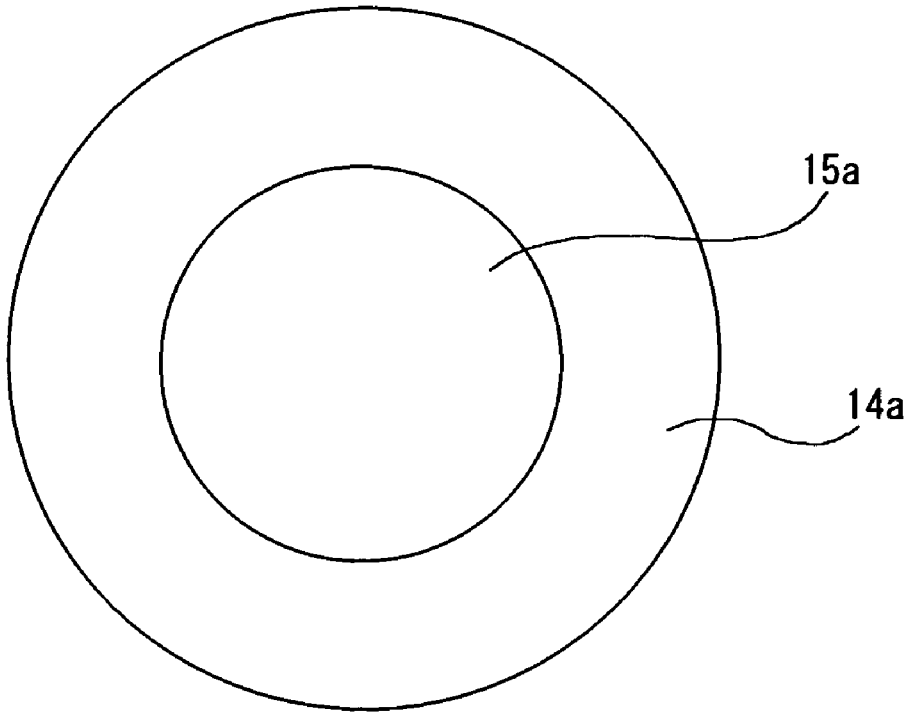
FIG. 3 is a plan view showing the arrangement of a hard pad and a counter electrode according to Configuration Example 1.

In this configuration example, as shown in the plan view in FIG. 3, a polishing pad 14*a* is formed in a roughly annular shape, and a counter electrode 15*a* formed in a circular disk-like shape having an outside diameter nearly equal to the inside diameter of the polishing pad 14*a* is fitted in the polishing pad 14*a*.

Configuration Example 2

Figure 4:
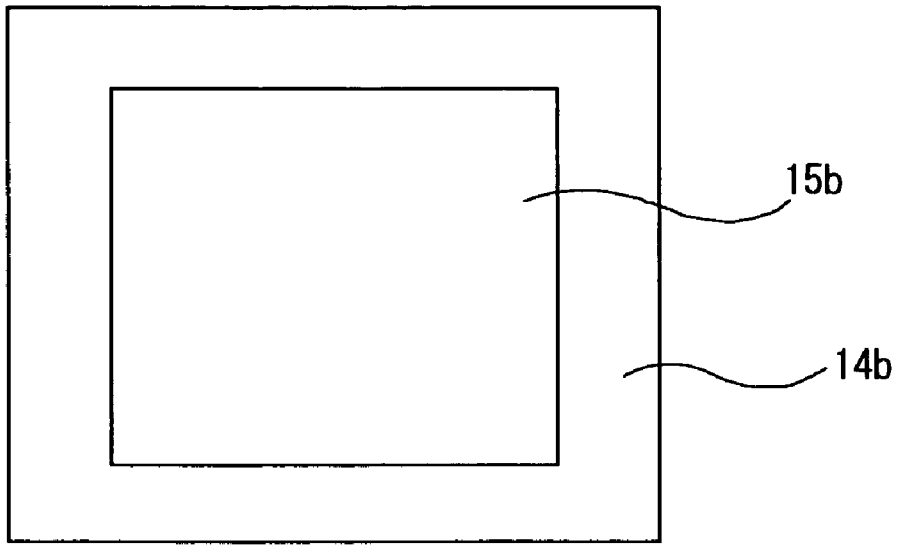
FIG. 4 is a plan view showing the arrangement of a hard pad and a counter electrode according to Configuration Example 2.

In this configuration example, as shown in the plan view in FIG. 4, a polishing pad 14*b* is in such a shape that a central portion of a rectangular parallelopiped has been cut out in a roughly rectangular shape, and a counter electrode 15*b* formed in a plate-like shape nearly equal to the cutout shape of the polishing pad 14*b* is fitted in the polishing pad 14*b*.

Configuration Example 3

Figure 5:
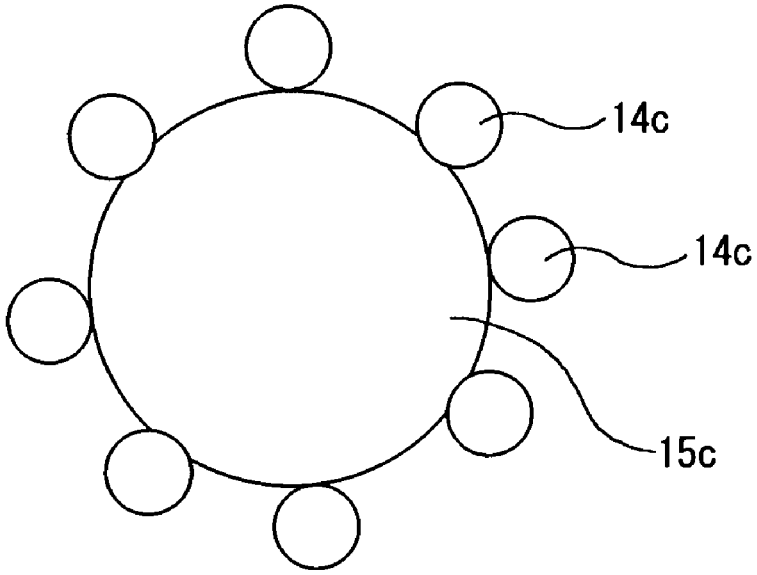
FIG. 5 is a plan view showing the arrangement of a hard pad and a counter electrode according to Configuration Example 3.

In this configuration example, as shown in the plan view in FIG. 5, a counter electrode 15*c* is formed in a roughly circular disk-like shape, and polishing pads 14*c* formed in a roughly circular disk-like shape slightly smaller in diameter than the counter electrode 15*c* are arranged at roughly regular intervals along the outer circumferential portion of the counter electrode 15*c*, in contact with the outer circumference of the counter electrode 15*c*.

Configuration Example 4

Figure 6:
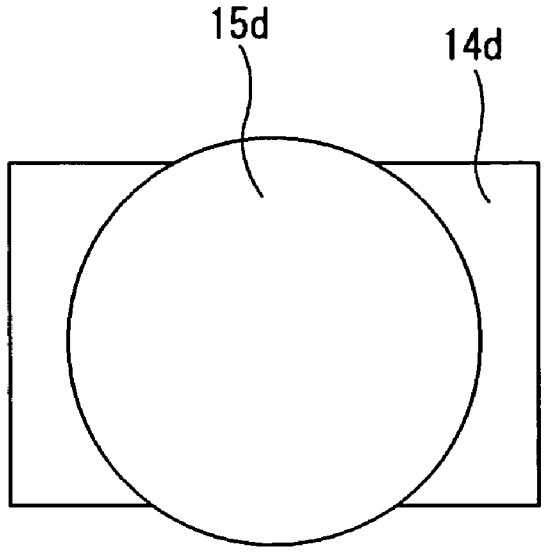
FIG. 6 is a plan view showing the arrangement of a hard pad and a counter electrode according to Configuration Example 4.

In this configuration example, as shown in the plan view in FIG. 6, a polishing pad 14*d* is formed in such a shape that a central portion of a rectangular parallelopipes has been cut out in a roughly circular shape, and a counter electrode 15*d* formed in a circular disk-like shape nearly equal to the cutout shape of the polishing pad 14*d* is fitted in the polishing pad 14*d*.

Configuration Example 5

Figure 7:
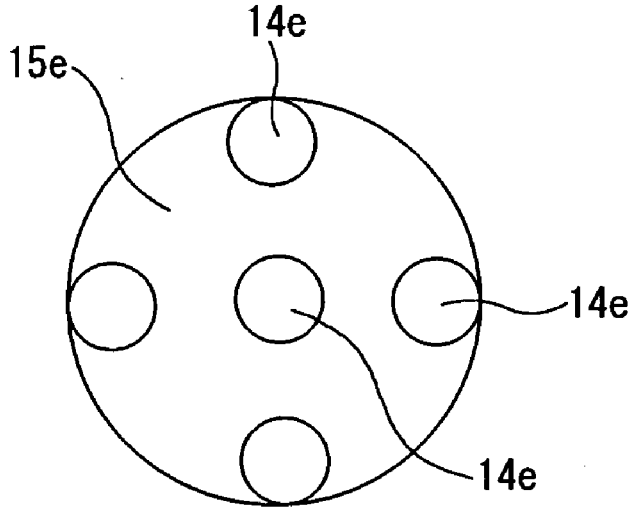
FIG. 7 is a plan view showing the arrangement of a hard pad and a counter electrode according to Configuration Example 5.

In this configuration example, as shown in the plan view in FIG. 7, a counter electrode 15*e* is formed in a roughly circular disk-like shape, and polishing pads 14*e* formed in a circular disk-like shape much smaller in diameter than the counter electrode 15*e* are disposed at a central portion and at roughly regular intervals along a outer circumferential portion, of a principal surface of the counter electrode 15*e*.

Configuration Example 6

Figure 8:
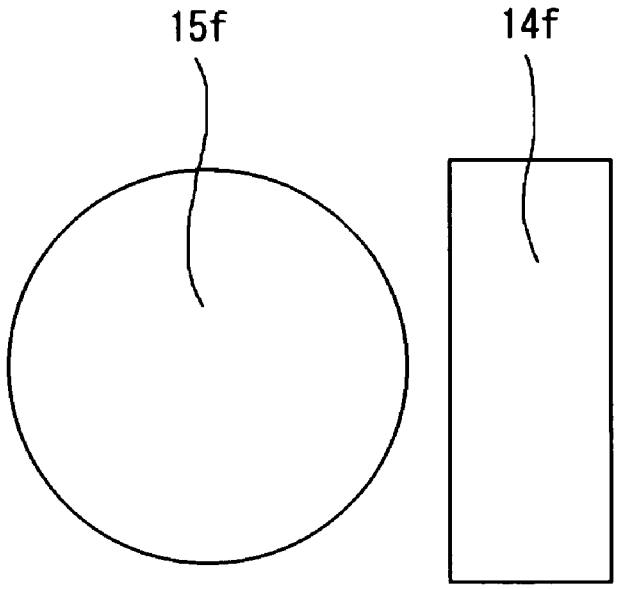
FIG. 8 is a plan view showing the arrangement of a hard pad and a counter electrode according to Configuration Example 6.

In this configuration example, as shown in the plan view in FIG. 8, a counter electrode 15*f* is formed in a roughly circular disk-like shape, and a polishing pad 14*f* formed in a roughly rectangular parallelopiped shape is disposed at a lateral side of the counter electrode 15*f*, at a distance from and independently of the counter electrode 15*f*.

Configuration Example 7

Figure 9:
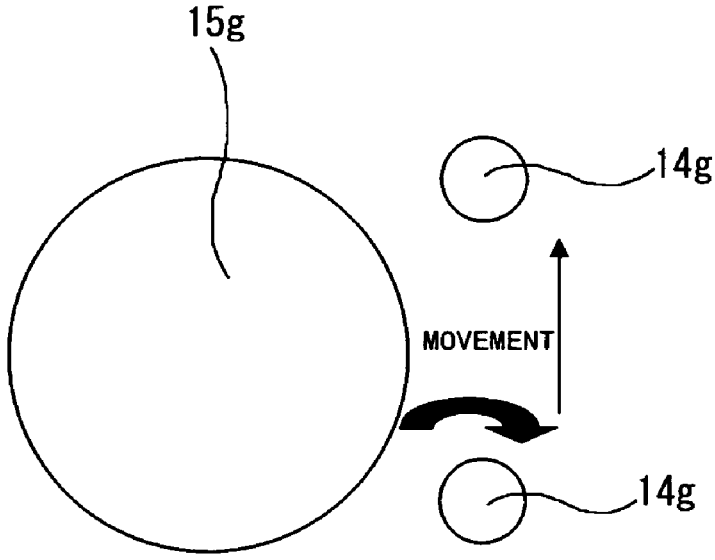
FIG. 9 is a plan view showing the arrangement of a hard pad and a counter electrode according to Configuration Example 7.

In this configuration example, as shown in the plan view in FIG. 9, a counter electrode 15*g* is formed in a roughly circular disk-like shape, and a polishing pad 14*g* formed in a roughly circular disk-like shape much smaller in diameter than the counter electrode 15*g* is disposed in the vicinity of the outer circumference of the counter electrode 15*g* and is moved within the electrode range while being rotated.

In the present invention, the hard pad as above-mentioned is used as the polishing pad, whereby it is possible to prevent the problems which might be encountered in the Cu CMP, such as erosion, dishing, recess, and delamination of a low dielectric constant material, and to obtain the following effects.

First, according to the present invention, it is possible to realize a planarity with a higher accuracy as compared with that by the related-art method, so that it is possible to contrive an enhancement of the planarity of the semiconductor device, and to obtain an effect in enhancing the processing accuracy of lithography as well as an effect in suppressing the defects (wiring shortcircuit, etc.) generated at the time of integration in the case of an increased number of wiring layers. By these effects, it is possible to realize an enhanced yield in the semiconductor mass production process.

That is to say, according to the present invention, the defects generated in planarization by the Cu CMP, such as erosion, dishing, recess, and delamination of the inter-layer insulation film can be prevented from being generated, so that it is possible to produce a larger number of non-defective chips from a predetermined semiconductor wafer, and to enhance the yield of the semiconductor wafer. As a result, it is possible to manufacture a high-added-value product with a substantial rise in chip unit price. In addition, the enhancement of yield suppresses the discarding of defective chips, which means a high added value on an environmental basis.

Besides, according to the present invention, it is possible to process the wiring height as designed and with high accuracy. Therefore, a current density in excess of the designed range is prevented from flowing, so that the electromigration (EM) resistance is not degraded, and reliability of the wiring can be secured.

In the planarization by the Cu CMP, the wiring shape obtained differs greatly from that in the device design, due to erosion and the like, and the designed device characteristics and reliability cannot be secured. When the present invention is applied, on the other hand, it is possible to obtain a wiring shape substantially equal to that in the device design, and the expected device characteristics and reliability can both be secured.

In addition, according to the present invention, a low dielectric constant material for obviating the wiring delay can be applied, and high-speed devices can be developed and mass-produced. Attendant on this, it is possible to design a device with an enhanced added value. Specifically, according to the present invention, it is possible to apply a low dielectric constant film as the inter-layer insulation film attendant on an increased speed of semiconductor device, which promises a differentiation relative to devices manufactured without application of the low dielectric constant film.

Furthermore, in design rule, it is unnecessary to set prohibition rules such as those in the related art, and it is possible to achieve a design with a high degree of freedom. Specifically, while it has been necessary in the Cu planarization by the Cu CMP to design a device taking into account the shape changes upon planarization, the application of Cu planarization by the polishing according to the present invention makes it possible to process into a shape conforming to the device design, so that a marginless designing can be performed. Attendant on this, the degree of freedom in designing is enhanced, and there is no need for excess additional designing.

Besides, by use of the hard pad as the polishing pad, wearing or consumption of the polishing pad 14 itself is lessened. This leads to a longer life of the polishing pad 14, which is a consumable article, so that the manufacturing cost can be reduced.

Next, the application of the above-described polishing method to the method of manufacturing a semiconductor device will be described, taking as an example the case where the manufacturing method is applied to a copper wiring forming process by the Damascene method in manufacturing a semiconductor device.

Figure 10:
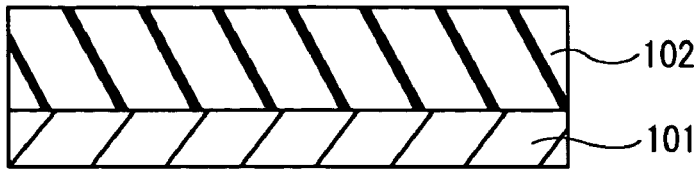
FIG. 10 is a sectional view of an essential part showing the condition where an inter-layer insulation film has been formed, for illustrating the method of manufacturing a semiconductor device according to the present invention.

First, as shown in FIG. 10, an inter-layer insulation film 102 composed, for example, of silicon oxide is formed on a wafer substrate 101 of silicon or the like appropriately provided, for example, with impurity regions (not shown), by a vacuum CVD (Chemical Vapor Deposition) method, for example. As the inter-layer insulation film 102, there can be used not only a silicon nitride film and a TEOS (tetraethyl orthosilicate) film formed by a CVD method but also the so-called Low-k (low dielectric constant film) material and the like. Here, examples of the low dielectric constant insulation film include SiF, SiOCH, polyaryl ether, porous silica, and polyimides.

Figure 11:
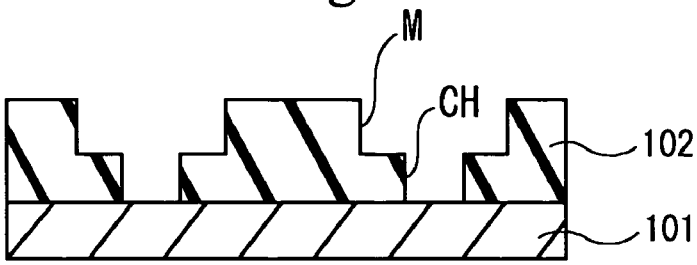
FIG. 11 is a sectional view of an essential part showing the condition where wiring trenches and contact holes have been formed, for illustrating the method of manufacturing a semiconductor device according to the present invention.

Next, as shown in FIG. 11, contact holes CH communicated with impurity regions of the wafer substrate 101 and wiring trenches for forming wirings in a predetermined pattern to be electrically connected to the impurity regions of the wafer substrate 101 are formed, by the conventionally known photolithography technique and etching technique.

Figure 12:
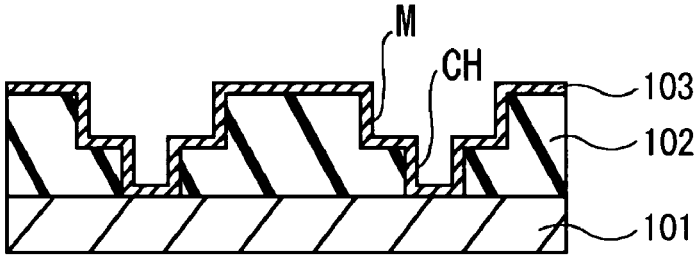
FIG. 12 is a sectional view of an essential part showing the condition where a barrier film has been formed, for illustrating the method of manufacturing a semiconductor device according to the present invention.

Subsequently, as shown in FIG. 12, a barrier film 103 is formed on the surface of the inter-layer insulation film 102 and in the inside of the contact holes CH and the wiring trenches M. The barrier film 103 is formed, for example, from such material as Ta, Ti, TaN, and TiN by a known sputtering method. The barrier film 103 is provided for preventing diffusion of copper into silicon oxide and the oxidation of copper, in view of the fact that, where the wirings are formed of copper and the inter-layer insulation film 102 is formed of silicon oxide, copper shows a high coefficient of diffusion into silicon oxide and is susceptible to oxidation.

Figure 13:
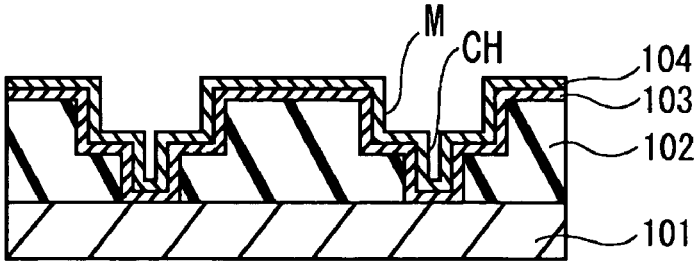
FIG. 13 is a sectional view of an essential part showing the condition where a seed film has been formed, for illustrating the method of manufacturing a semiconductor device according to the present invention.

Next, as shown in FIG. 13, copper is deposited in a predetermined film thickness on the barrier film 103 by a known sputtering method, to form a seed film 104. The seed film 104 is provided for accelerating the growth of copper grains when the wiring trenches M and the contact holes CH are filled up with copper.

Figure 14:
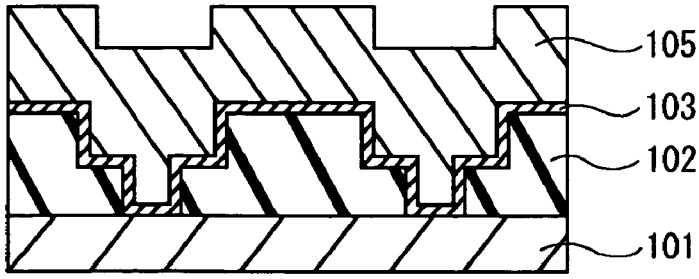
FIG. 14 is a sectional view of an essential part showing the condition where a Cu film has been formed, for illustrating the method of manufacturing a semiconductor device according to the present invention.

Subsequently, as shown in FIG. 14, a Cu film 15 is formed so as to fill up the contact holes CH and the wiring trenches M. The Cu film 105 is formed, for example, by a plating method, a CVD method, a sputtering method or the like. Incidentally, the seed film 104 is integrated with the Cu film 105. The surface of the Cu film 105 has an unevenness due to the presence of excess portions of the Cu film 105, generated by the filling of the contact holes CH and the wiring trenches M.

Figure 15:
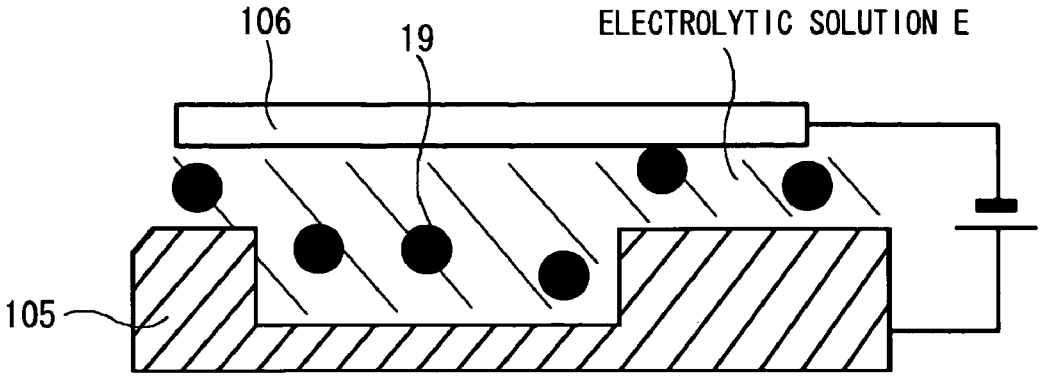
FIG. 15 is a view showing the condition where wiring trenches and contact holes have been formed, for illustrating the method of manufacturing a semiconductor device according to the present invention.
Figure 16:
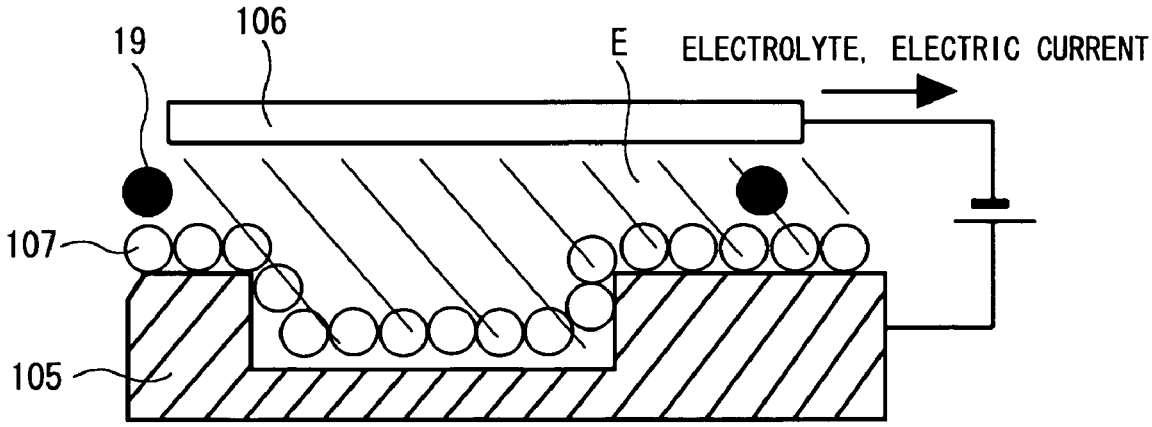
FIG. 16 illustrates a polishing step, for illustrating the method of manufacturing a semiconductor device according to the present invention.
Figure 17:
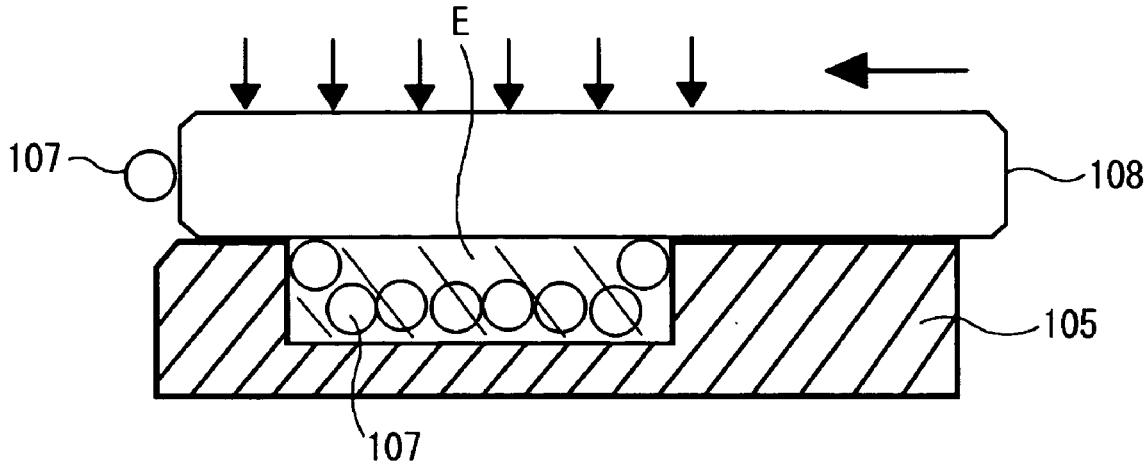
FIG. 17 illustrates a polishing step, for illustrating the method of manufacturing a semiconductor device according to the present invention.
Figure 18:
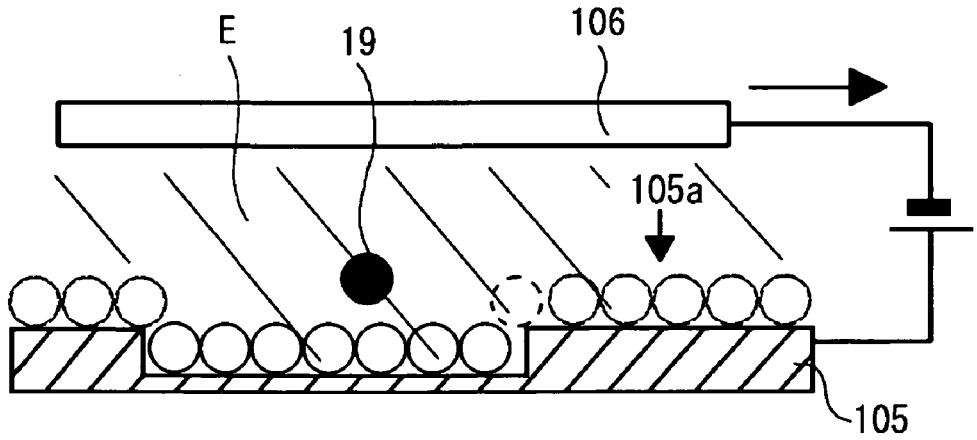
FIG. 18 illustrates a polishing step, for illustrating the method of manufacturing a semiconductor device according to the present invention.
Figure 19:
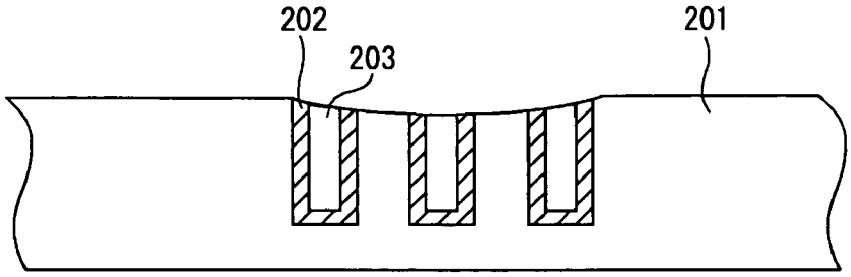
FIG. 19 is a sectional view of an essential part, showing one example of Cu wirings formed by a Cu wiring process using CMP according to the related art.
Figure 20:
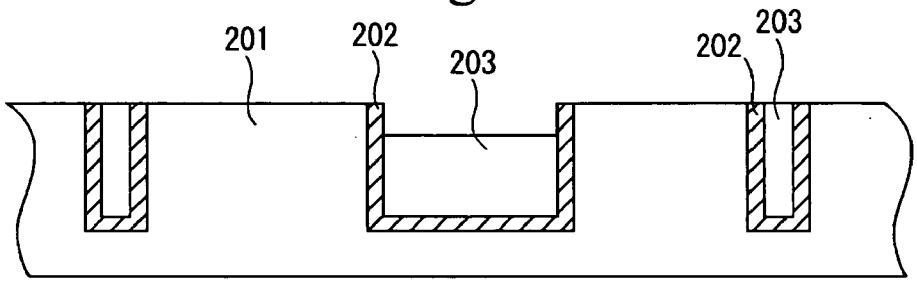
FIG. 20 is a sectional view of an essential part, showing another example of Cu wirings formed by a Cu wiring process using CMP according to the related art.
Figure 21:
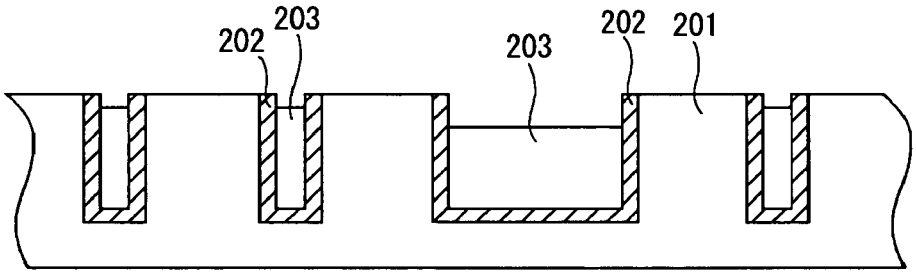
FIG. 21 is a sectional view of an essential part, showing a further example of Cu wirings formed by a Cu wiring process using CMP according to the related art.
Figure 22:
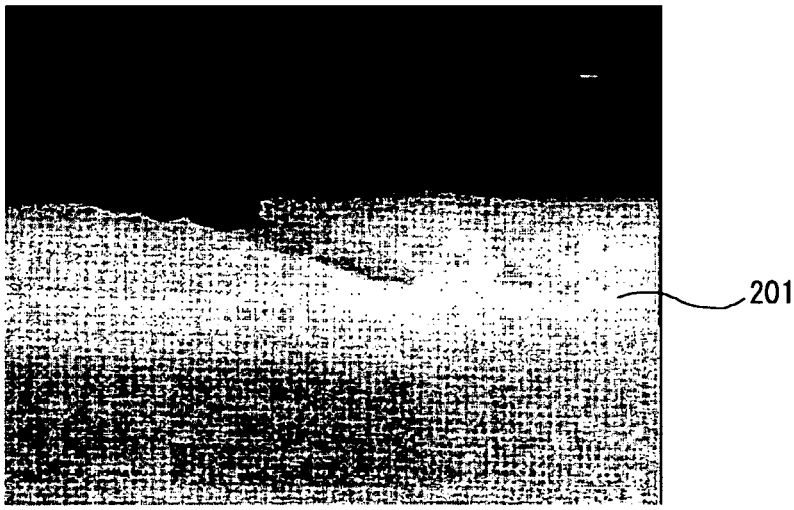
FIG. 22 shows the condition where a low dielectric constant material of an inter-layer insulation film has been delaminated.
Figure 23:
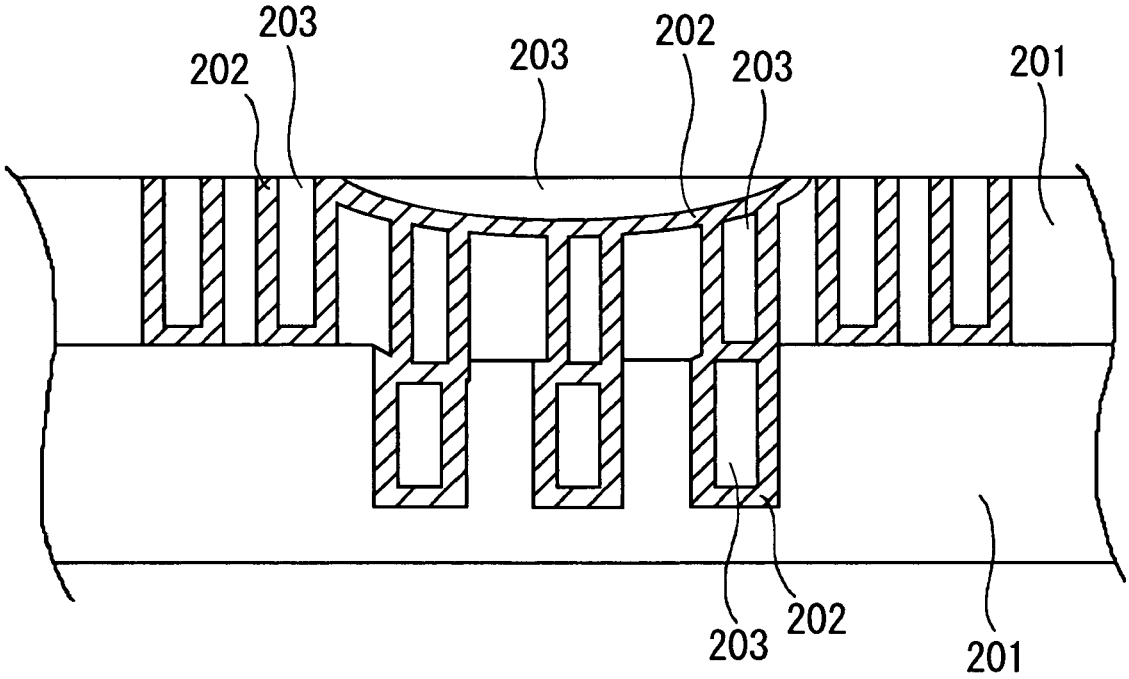
FIG. 23 is a sectional view of an essential part, showing one example of Cu wirings formed by a Cu wiring process using CMP according to the related art.

Next, the excess portions of the Cu film 15 on the inter-layer insulation film 102 are polished away, to obtain a planar shape. Specifically, a polishing step is applied to the wafer substrate 101 provided with the Cu film 105 as above-mentioned, and, in the polishing step, the polishing by the electropolishing and the simultaneous wiping with the polishing pad as above-mentioned is conducted. To be more specific, in the condition where the Cu film 105 and a counter electrode 106 are disposed oppositely to each other in an electrolytic solution E as shown in FIG. 15, an electric current is passed with the Cu film 105 as anode as shown in FIG. 16, to pass electric current through electrolyte for performing the electropolishing, whereby the surface of the Cu film 105 is anodically oxidized, to form a reaction layer composed of a copper complex 107. Simultaneously, as shown in FIG. 17, wiping is conducted by pressing a polishing pad 108 against the Cu film 105 under a predetermined pressure, specifically, a pressure of not more than 2 PSI (1 PSI is equivalent to about 70 g/cm$^2$) and sliding the polishing pad 108 on the Cu film 105, to remove the reaction layer composed of the copper complex 107, thereby exposing the underlying copper 105*a* of the Cu film 105, as shown in FIG. 18. Here, the above-described hard pad is used as the polishing pad 108.

Upon the wiping with the polishing pad 108, only the reaction layer on projected portions of the Cu film 105 is removed, whereas the reaction layer in recessed portions of the Cu film 105 is left as it is. Then, the electropolishing is made to proceed, whereby the underlying copper 105*a* is further oxidized anodically. In this case, since the reaction layer composed of the copper complex 107 is left in the recessed portions of the Cu film 105 as above-mentioned, the electropolishing does not proceed in the recessed portions, and, as a result, only the projected portions of the Cu film 105 are polished away. In this manner, the formation of the reaction layer by electropolishing and the removal of the reaction layer by wiping are repeatedly conducted, whereby the Cu film 105 is planarized, and Cu wirings are formed in the wiring trenches M and the contact holes CH.

In manufacturing the semiconductor device, the above-described polishing step is followed by polishing of the barrier film 103 and cleaning, then by formation of a cap film on the wafer substrate 101 provided with the Cu wirings. Then, the steps ranging from the formation of the inter-layer insulation film 102 (shown in FIG. 10) to the formation of the cap film are repeated, to form a multi-layer wiring.

As has been described above, by conducting the polishing method including the electropolishing and the wiping in the process of manufacturing a semiconductor device, the electric current is passed stably and with a uniform current density distribution, and planarization of the Cu film 105 is contrived by the electropolishing which proceeds under favorable polishing rate and polishing conditions up to the end point of polishing, so that such troubles as remaining of Cu and over-polishing are prevented from occurring. Therefore, it is possible to restrain the generation of such troubles as shortcircuit and opening in the Cu wirings, and to form a smooth surface having a stable wiring electric resistance.

In addition, the wiping of the reaction layer is conducted under a pressing pressure much lower than that in the CMP, specifically, a pressing pressure lower than the delaminating pressure of the inter-layer insulation film 102 formed of a low dielectric constant material such as porous silica and having a low strength, for example, a pressing pressure of 2 PSI or below, so that delamination of the inter-layer insulation film 102 such as exfoliation and cracking is prevented from occurring.

Besides, in the method of manufacturing a semiconductor device as above-described, an electrolytic liquid containing abrasive grains can be used in the above polishing step, for enhancing the planarizing ability.

Incidentally, the present invention can naturally be carried out not only in the polishing step in manufacturing a semiconductor device but also in any other manufacturing processes including a step of polishing a metallic film.

The polishing method according to the present invention includes the steps of: disposing a substrate provided thereon with a metallic film and a counter electrode oppositely to each other in an electrolytic solution, passing an electric current to the metallic film through the electrolytic solution, and polishing the surface of the metallic film with a hard pad, to thereby polish the metallic film.

In addition, the polishing apparatus according to the present invention is a polishing apparatus for polishing in an electrolytic solution a metallic film formed on a substrate, including the steps of: a counter electrode disposed oppositely to the substrate; a power source for supplying a voltage, with the substrate as anode and with the counter electrode as cathode; and a hard pad slidingly moved on the substrate so as to polish the metallic film.

Besides, the method of manufacturing a semiconductor device according to the present invention is a method of manufacturing a semiconductor device, including the steps of: providing an insulation film formed on a substrate with wiring trenches for forming metallic wirings, forming a metallic film on the insulation film so as to fill up the wiring trenches, and polishing the metallic film formed on the insulation film, wherein, in the step of polishing the metallic film, the substrate provided with the metallic film and a counter electrode are disposed oppositely to each other in an electrolytic solution, an electric current is passed to the metallic film through the electrolytic solution, and polishing the surface of the metallic film with a hard pad, to thereby polish the metallic film.

According to the polishing method and polishing apparatus of the present invention as above-described, a metallic film is polished under the compound action of electropolishing and wiping, so that selective removal of projected portions of the metallic film and planarization can be performed extremely efficiently, as compared with the case of planarizing a metallic film by the related-art CMP.

In addition, according to the polishing apparatus and polishing method of the present invention, polishing is conducted by wiping while using a hard pad under a sufficiently low polishing pressure, so that polishing with high accuracy can be realized while restraining scratches, dishing, erosion, etc. from being generated in the metallic film polished.

Furthermore, according to the present invention, a sufficient polishing rate can be obtained even under a sufficiently low polishing pressure; therefore, the present invention is applicable also to the case where a low dielectric constant film having a comparatively low mechanical strength is used as an inter-layer insulation film for reducing the dielectric constant from the viewpoint of manufacturing a semiconductor device with a lowered power consumption, an enhanced speed and the like.

Besides, according to the method of manufacturing a semiconductor device according to the present invention in which the above-described polishing method is utilized, the same effects as those of the above-described polishing method can be obtained, so that metallic wirings with high reliability and favorable shape can be formed easily and robustly.

The invention claimed is:

1. A polishing method comprising the steps of:

providing a substrate having a metallic film thereon and a counter electrode spaced from said substrate in an electrolytic solution;

passing an electric current to said metallic film through said electrolytic solution, and polishing the surface of said metallic film with a hard pad, to thereby polish said metallic film, wherein said hard pad has a compressive strength, per 1 mm thickness under 0.01% compression, of not more than 7 kPa.

2. A polishing apparatus for polishing a metallic film formed on a substrate in an electrolytic solution, said apparatus comprising:

a counter electrode spaced from said substrate;

a power source for supplying a voltage, wherein said substrate forms an anode and said counter electrode forms a cathode; and a hard pad slidingly moved over said substrate so as to polish said metallic film, wherein said hard pad has a compressive strength, per 1 mm thickness under 0.01% compression, of not less than 7 kPa.

* * * * *